US005265533A

United States Patent [19]

Svantesson, deceased et al.

[11] Patent Number: 5,265,533

[45] Date of Patent: Nov. 30, 1993

[54] STENCIL PRINTING MACHINE

[76] Inventors: Åke Svantesson, deceased, late of Huddinge; by Kirsti K. Svantesson, legal representative, Tranvägen 28, 141 72 Huddinge, both of Sweden

[21] Appl. No.: 768,723

[22] PCT Filed: Apr. 5, 1990

[86] PCT No.: PCT/SE90/00231

§ 371 Date: Oct. 19, 1992

§ 102(e) Date: Oct. 19, 1992

[87] PCT Pub. No.: WO90/11891

PCT Pub. Date: Oct. 18, 1990

[30] Foreign Application Priority Data

Apr. 10, 1989 [SE] Sweden ..... 8901259

[51] Int. Cl.[5] ..... B05C 17/04

[52] U.S. Cl. ..... 101/123; 101/126

[58] Field of Search ..... 101/114, 123, 124, 125, 101/126, 127.1, 129

[56] References Cited

U.S. PATENT DOCUMENTS

| | | | |
|---|---|---|---|
| 3,384,010 | 5/1968 | Cotterell | 101/126 |
| 3,505,951 | 4/1970 | Gartrell | 101/123 |
| 3,874,289 | 4/1975 | Valentin | 101/123 |
| 3,915,088 | 10/1975 | Svantesson et al. | 101/124 |
| 4,240,343 | 12/1980 | Monvoisin | 101/126 |
| 4,254,707 | 3/1981 | Lambert et al. | 101/129 |
| 4,267,773 | 5/1981 | Scherp et al. | 101/123 |
| 4,485,736 | 12/1984 | Strutz, Jr. et al. | 101/123 |
| 4,498,386 | 2/1985 | Rouzy et al. | 101/126 |
| 4,516,495 | 5/1985 | Ericsson | 101/129 |
| 4,589,336 | 5/1986 | Klemm | 101/123 |
| 4,592,277 | 6/1986 | Dennesen et al. | 101/126 |
| 4,781,114 | 11/1988 | Ericsson | 101/123 |
| 4,848,226 | 7/1989 | Svantesson | 101/126 |
| 4,909,145 | 3/1990 | Ericsson | 101/123 |
| 4,911,071 | 3/1990 | Svantesson | 101/129 |
| 4,913,344 | 3/1980 | Ericsson | 101/129 |
| 4,919,043 | 4/1990 | Bubley et al. | 101/123 |
| 5,036,760 | 8/1991 | Oozekl et al. | 101/123 |
| 5,101,722 | 4/1992 | Nagatani | 101/124 |

*Primary Examiner*—Eugene H. Eickholt

*Attorney, Agent, or Firm*—Burns, Doane, Swecker & Mathis

[57] ABSTRACT

A silk screen printer includes a printing table, a stencil held in a frame, and a squeegee which is movable relative to the frame to enable a first pattern on the stencil to be transferred to print material registered on the printing table in order to form a second pattern. During an actual printing sequence, the squeegee is intended to move over the stencil and relative to the frame in a first direction, whereas the stencil and the stencil-frame are intended to move in another direction opposite to the first direction. The printing table is a flat printing-table, which can be displaced synchronously with the frame. During a printing sequence, a gripper operative to collect print material located in a laying-on station is registered to the printing table for movement in common therewith.

8 Claims, 1 Drawing Sheet

STENCIL PRINTING MACHINE

TECHNICAL FIELD

The present invention relates to a silk screen printer and more particularly to a silk screen printer of the kind which comprises a printing table, a frame-held stencil, and a squeegee which can be displaced relative to the stencil frame, such that a first pattern formed on the stencil can be applied to print material registered in a printing position on said table and therewith form a second pattern on said material, by forcing ink, paste, lacquer or varnish through a pattern of holes formed in the stencil and corresponding to said first pattern, with the aid of said squeegee.

The invention is concerned particularly with silk screen printers of the kind in which the printing table is flat and functions to support thin material to which the second pattern is to be applied.

Although the printer is constructed to print thin material, it will be understood that the printer is also able to print thick and stiff material, provided that said material can be held firmly by grippers provided therefor.

BACKGROUND ART

Various silk screen printer of this kind are known to the art. In addition to endeavours to increase the printing speed of such printers, endeavours have also been made constantly to enable the second pattern to be applied to print material with no positional discrepancy or with only a small positional discrepancy.

The demand for high printing speeds, e.g. speeds in excess of 1500 prints per hour, is normally counteractive to the demand for small positional discrepancies.

An example of one known printer equipped with a flat printing table with which a high printing speed is desired and where discrepancies can be kept low is described and illustrated in U.S. Pat. No. 4,516,495.

In view of the measures taken in the development of the present invention, mention should perhaps also be made to U.S. Pat. No. 3,874,289, and particularly to FIGS. 8 and 9 of this specification, which teaches a silk screen printer which lacks a flat printing table but in which measures have been taken to cause the squeegee to move over the stencil and relative to the stencil frame in a first direction during an actual printing sequence while the stencil and stencil-frame are arranged to move in a second direction opposite to said first direction. The second direction coincides with the speed and direction of the movement of a flat and/or an angled object. It can be assumed that the speed of the object in relation to a stand which forms part of the silk screen printer is synchronized with the speed of the stencil frame relative to said stand.

SUMMARY OF THE INVENTION

Technical Problems

A study of the present standpoint of techniques as described above will show that in the case of a silk screen printer equipped with a flat printing table, a frame-carried stencil, and a squeegee which can be moved relative to the stencil-frame, a qualified technical problem resides in the ability to create, with the aid of simple means, conditions which will enable movement of the squeegee, the length of squeegee movement, and the length of stencil or stencil-frame movement to be reduced, so as to enable the printing speed of the printer to be increased drastically as a result of these shorter distances.

It will also be seen that a technical problem resides in the provision of a silk screen printer equipped with a flat printing table and intended for printing relatively thin material with which the aforesaid problem has been solved and therewith provide a simple gripping arrangement and a simple movement of print material from a laying-on position to a printing position and from a printing position to a laying-off.

Another technical problem associated with a silk screen printer of the aforesaid kind equipped with a flat printing table is one of realizing the advantages that can be gained when the printing table is able to move reciprocatingly in synchronism with the stencil and stencil-frame, and also of realizing that the gripper means need not be registered relative to the printing table solely in a known manner, but can accompany the printing table in its direction of movement during the printing sequence, and in other respects adapt the path of movement and speed of the gripping means to the aforesaid conditions.

It will also be seen that a further qualified technical problem associated with a silk screen printer having a flat printing table and intended to solve one or more of the aforesaid technical problems is one of realizing the significance of utilizing a printing table which can be raised and lowered, in a manner known per se, and which during a printing sequence can be moved to an upper position such as to bring a gripper in a registered position when raised.

It will also be seen that a qualified technical problem is one of realizing the advantage of using known raisable and lowerable grippers, of which one gripper is intended to take an upper position when print material is intended to pass over the printing material to a material and gripper registering position, and then lowered to a registering position in coaction with the printing table.

It will also be seen that a technical problem associated with the use of a number of grippers related to one another via endless movement-transmission means, such as chains or the like, is one of realizing the advantage that can be gained by using said grippers and said transmission means in a known manner, such that said grippers and transmission means will move intermittently and therewith enable simultaneous registration of a first gripper in the laying-on position and registration of a second gripper relative to the printing table or stand in the printing position, and to afford coaction between grippers and printing table such that the gripper will finally be registered when the printing table is raised to its upper position.

Finally, it will be seen that a qualified technical problem is one of realizing the advantage that is gained when the movement path of the squeegee relative to the stand and the movement paths of the stencil-frame relative to said stand are of equal length and adapted particularly to the length dimension of the printed pattern in the movement or transport direction.

Solution

The present invention affords a solution to one or more of the aforesaid technical problems and said qualified technical deliberations, departing from a silk screen printer which incorporates a printing table, a frame-held stencil, and a squeegee which is movable in relation to said stencil-frame, such as to enable a first pattern formed on the stencil to be transferred, in the form of a second pattern, onto print material registered in position on the printing table, said material being so thin as to make it preferable for said material to rest on the printing table during the actual printing sequence.

The invention utilizes the principles applied in another basic silk-screen printer construction, namely that the squeegee shall be arranged for movement over the stencil and relative to the stencil-frame in a first direction during the actual printing sequence, while the stencil and stencil-frame are arranged to move in another direction opposite to the first direction.

With the aforesaid combination of features taken from a silk screen printer having a flat printing table and a silk screen printer adapted to print directly onto flat or right-angled objects, the present invention provides a unique coordination of printer features where the printing table is a flat printing-table and is reciprocatingly movable synchronously with the frame, and where grippers which collect print material from a laying-on position are registered with the printing table or printer stand for movement common therewith during the printing sequence.

According to one further embodiment of the invention, the printing table is capable of being raised and lowered and is intended to take an upper position during the printing sequence.

It is also proposed that the grippers can be raised and lowered and arranged to take an upper position when print material is intended to pass over the printing table to a material-and-gripper registering position.

According to a further embodiment of the invention, the speed at which the squeegee is able to move in relation to the stencil is twice as fast as its movement relative to a printer stand.

It also lies within the concept of the invention to relate a plurality of grippers one to the other, via endless movement-transmission means, such as chains, and to move the same intermittently, therewith enabling simultaneous registration of a first gripper in the laying-on position and registration of a second gripper in the printing table, this latter registration preferably being effected when the printing table is raised to its upper position.

Finally, the movement path of the squeegee relative to the printer stand and the movement path of the stencil-frame relative to said stand are of equal distance and are preferably adapted to the length extension of the printed pattern in the transport direction.

Advantages

Those advantages primarily afforded by an inventive silk screen printer reside in the possibilities of enabling a silk screen printer having a flat printing table to produce print at a speed which considerably exceeds the speed normally attainable with conventional silk screen printers having flat printing tables. It is expected, in this regard, to achieve an increase in printing speeds of more than 30%, and with normal printer sizes generating prints in the order of 70×100 cm, the inventive printer is able to achieve a printing capacity of above 2000 prints per hour.

Theoretical calculations indicate that the printing speed can be increased to values of between 50 and 80%.

The primary characteristic features of an inventive silk screen printer are set forth in the characterizing clause of the following Claim 1.

BRIEF DESCRIPTION OF THE DRAWINGS

The invention will now be described in more detail with reference to two exemplifying embodiments at present preferred and lying within the scope of the present invention, and also with reference to the accompanying drawings, in which.

DESCRIPTION OF EMBODIMENTS AT PRESENT PREFERRED

The following description is primarily intended to illustrate the function of a silk screen printer having a flat printing table and operating in accordance with the principles of the present invention, said description being made with reference to FIGS. 1-6 of the accompanying drawings. In order to simplify the drawings, the devices and constructional elements required for moving the squeegee, raising and lowering the frame, raising and lowering the printing table in respective displaced gripper-bars and for registering the same in respective registering positions have not been shown.

Mention will be made, however, in the following to those publications in which examples of such devices and constructional elements are illustrated.

Figure 1:
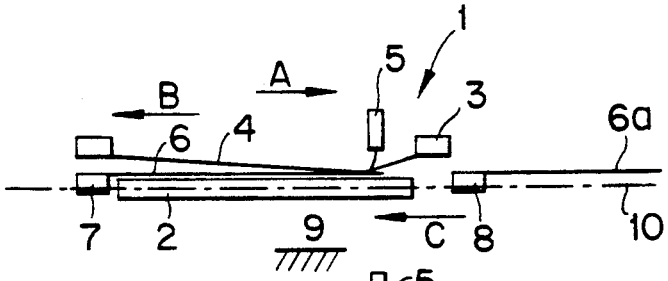
FIG. 1 illustrates highly schematically a first embodiment and illustrates the end of a printing sequence, with stencil, print material, gripper and printing table in a terminal position of a printing sequence.

Thus, as illustrated in FIG. 1, the present invention is based on a silk screen printer 1 which comprises a flat printing table 2, a stencil 4 stretched in a frame 3, and a squeegee 5 which is movable in the direction of arrow "A" relative to the frame 3 and the stencil 4, such as to transfer a first pattern on the stencil onto print material 6 registered in a printing position on the printing table 2, so as to form a second pattern on said print material. The frame 3 and the stencil 4 are arranged for movement in the direction of the arrow "B".

FIG. 1 also illustrates a first gripper 7 which is operative to hold the print material 6 during a printing sequence and which, in the illustrated position, is registered relative to a printer stand 9 or to the printing table 2.

In the position illustrated in FIG. 1, a second gripper 8 is operative to grip print material 6a located in the laying-on station.

The grippers 7 and 8 can be moved in unison to the left in FIG. 1, in the direction of the arrow "C", by an endless movement-transmission means, in the form of a chain 10. The gripper 8 is also registered relative to the stand 9 in the position illustrated in FIG. 1.

Any appropriate arrangement can be used for effecting movement of the grippers and for registering said grippers in position. An example of one such arrangement is described and illustrated in U.S. Pat. No. 4,221,165, FIGS. 1 and 1A.

FIG. 1 illustrates the mutual positions of the printing table 2, the frame 3, the squeegee 5, the print material 6 and 6a, and the grippers 7 and 8 at the end of a printing sequence, and the direction arrows "A", "B" and "C" indicate the movement of these printer members prior to the operational state of the printer illustrated in FIG. 1.

It should be noted that the various operational states of the printer illustrated in FIGS. 1-7 have been shown in a following sequence, so as to provide a clearer understanding of the mutual positions of displacement of the printer members.

Figure 2:
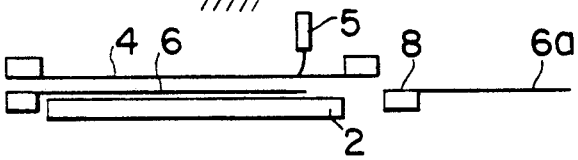
FIG. 2 illustrates subsequent and necessary raising of the squeegee.

As illustrated in FIG. 2, at the end of a printing sequence the squeegee 5 is raised, so as to release coaction of the stencil 4 with the print material 6, thereby enabling the print material 6 to be removed from the printing position and also to enable the print material 6a located on the laying-on station to be moved to the printing position by means of the gripper 8.

Figure 3:
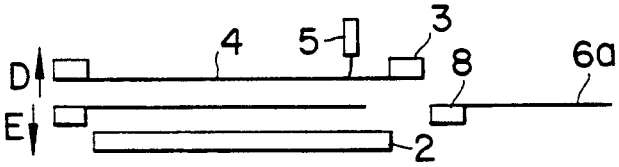
FIG. 3 illustrates subsequent and necessary raising of the squeegee, frame and stencil in the form of a unit, and simultaneous lowering of the printing table.

FIG. 3 illustrates the operational state of the printer immediately after the operational state illustrated in FIG. 2, and the arrow "D" indicates that the frame 3, together with the stencil 4, and the squeegee 5 have been raised to a position in which print material and gripper are able to pass freely therebeneath.

The reference sign "E" indicates that the flat printing table 2 is, at the same time, caused to take a lower position, so as to enable free passage of the gripper 8 and further print material 6a immediately above the printing table, to the material printing position.

With particular reference to the positions of the printer members illustrated in FIGS. 1 to 3, FIG. 4 shows that the frame 3, together with the stencil 4, is then displaced horizontally in the direction of the arrow "F", somewhat to the right, at the same time as the squeegee 5 is displaced horizontally to the left through an equally long distance for refilling purposes, as indicated by the arrow "G".

The arrow "H" illustrates that the flat printing table 2 is also displaced horizontally to the right. This displacement of the printing table 2 and the frame 3 (together with the stencil 4) takes place synchronously through the intermediary of an arrangement not shown.

Figure 4:
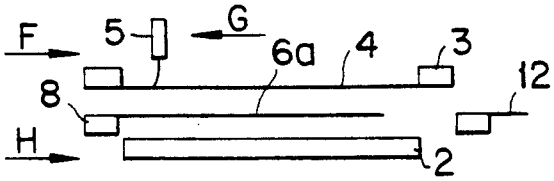
FIG. 4 illustrates a later position or state, in which print-material placed in the laying-on position by means of a gripper has been displaced between stencil and printing table, which have been caused to carry out a return movement during displacement of said print material.

At the same time as the frame 3 and the printing table 2 are displaced horizontally to the right, the gripper 8 is displaced to the left, so as to take the position illustrated in FIG. 4 and therewith place the print material 6a in the printing position.

It should be noted that the gripper 12 does not grip print material in this position, since new print-material shall be gripped by the gripper 12 when the gripper is registered.

Figure 5:
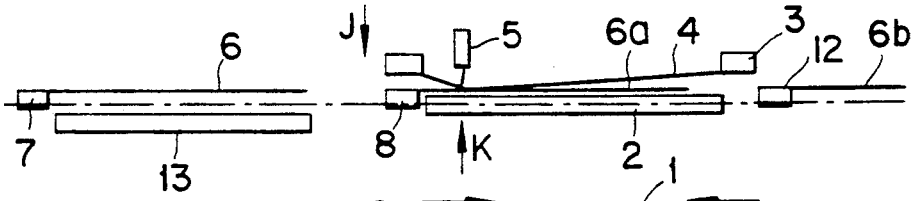
FIG. 5 illustrates a following position of the squeegee, frame and stencil in positions coacting with the print material and with with the printing table in an upper position so as to enable a printing sequence to commence.

The arrow "J" in FIG. 5 illustrates that the frame 3, together with the stencil 4, and the squeegee 5 adopt a lower position in which the squeegee 5 urges the stencil 4 against the print material 6a, while the arrow "K" illustrates that the flat printing table 2 is now in its upper position, the same position as that shown in FIG. 1, in which it supports the print material.

It will also be seen that the print material 6 has been transported to a laying-off position, by the gripper 7, the reference 13 illustrating a laying-off table.

As will also be seen from FIG. 5, a registered gripper 12 now grips new print-material 6b located in the laying-on station and intended for print.

Figure 6:
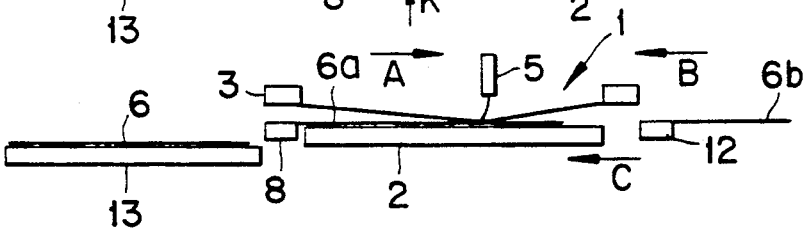
FIG. 6 illustrates an operational state during an ongoing printing sequence immediately before reaching the operational state illustrated in FIG. 1.

Finally, FIG. 6 illustrates that during an actual printing sequence, the gripper 8, the print-material 6a, the table 2 and the frame 3 are moved in unison, i.e. together, to the left, while maintaining registration between gripper 8 and the table 2, at the same time as the squeegee 5 is moved horizontally to the right in the direction of the arrow "A". The printing speed is the sum of these movements.

It should be noted in particular that during the time period in which the frame 3 and the printing table 2 are displaced from the position illustrated in FIG. 3 to the position illustrated in FIG. 4, at the same time as the squeegee is moved from the position shown in FIG. 3 to the position shown in FIG. 4, the gripper 8 will move the print material 6a from the FIG. 3 position to the FIG. 4 position, which means that movement of the gripper 8 and the print material 6a will take place at a greater speed from the FIG. 3 position to the FIG. 4 position than the events occurring during the printing sequence in FIG. 6. Thus, the endless movement-transmission means shall be capable of being driven at mutually different speeds at mutually different times, determined by the positions of the frame and the table 2.

Figure 7:
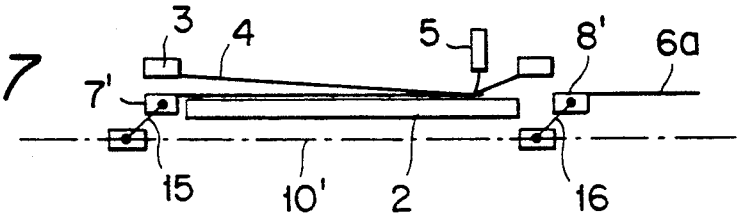
FIG. 7 illustrates a second embodiment of a silk screen printer with stencil-frame, print material and printing table in the operational position shown in FIG. 1.

FIG. 7 illustrates a modified embodiment, in which the grippers 7', 8' can be raised and lowered by means of a link-arm arrangment 15, 16, and in which the endless movement-transmission means 10' has a slightly modified configuration than the movement-transmission means described with reference to FIGS. 1-6.

It will be obvious that the printing table 2 is stationary relative to the stand and that movement of the gripper 8' takes place over the printing table 2 when the frame 3 is in its upper position, illustrated in FIG. 3. This will ensure that a sufficiently large space is obtained between the frame 3 and the uppermost surface of the printing table 2, so as to enable the gripper 8 with print material 6a held thereby to pass over the printing table 2.

The operational state illustrated in FIG. 7 corresponds to the operational state illustrated in FIG. 1. It is evident that the embodiment illustrated in FIG. 7 can take positions which conform to the positions illustrated in FIGS. 2-5, and also in FIG. 6, although such positions are not shown, since they are considered to be obvious.

Thus, in the case of both embodiments, the printing table comprises a flat printing-table 2 which can be moved reciprocatingly in synchronism with the frame 3, and that during a printing sequence a gripper 8 operative to collect print material 6a from the laying-on station is registered in the printing table for common movement therewith.

Furthermore, the squeegee 5, during a printing sequence, is arranged to move in relation to the stencil at twice the speed that it moves relative to the stand 9 of the printer. Furthermore, the grippers are related to one another via endless movement-transmission means (chains) and are moved intermittently, via machinery not shown. This enables simultaneous registration of a first gripper in the laying-on station and registration of a second gripper in the printing table, when said table is raised to its upper position or the gripper is lowered to its lower position. The gripper may conveniently be provided with pins intended for coaction with holes in the printing table.

The movement path of the squeegee in relation to the printer stand and the movement path of the frame relative to said stand are mutually equal and adapted to the length extension of the print pattern in the transport direction.

A silk screen printer provided with a raisable and lowerable gripper is described and illustrated in European Patent Specification 0 109 598.

A silk screen printer having a raisable and lowerable printing table is illustrated and described in U.S. Pat. No. 3,384,010.

It will be understood that the invention is not restricted to the aforedescribed exemplifying embodiments thereof and that modifications can be made within the scope of the following claims.

What is claimed is:

1. A silk screen printer comprising a printing table, a stencil held in a frame, a squeegee, a gripper for gripping print material in a laying-on station, and means for moving the squeegee, the printing table, the frame and the gripper, said squeegee being movable relative to the frame to transfer a first pattern on the stencil to print material registered on the printing table to form a second pattern, said squeegee being movable over the stencil and relative to the frame in a first direction during an actual printing sequence, whereas the stencil and frame are arranged to move in a second direction opposite to said first direction, the printing table being a flat printing-table which is arranged to move reciprocatingly in synchronism with the frame, and in that during a printing sequence the gripper is registered relative to the printing table for movement in common therewith.

2. An arrangement according to claim 1, wherein the printing table can be raised and lowered, and is intended to take an upper position during a printing sequence.

3. An arrangement according to claim 1, wherein the gripper can be raised and lowered, and is intended to take an upper position when print material passes over the printing table to a position in which the material and gripper are registered for printing.

4. An arrangement according to claim 1, wherein the squeegee is arranged to move, during a printing sequence, at twice the speed in relation to the stencil than in relation to a stand forming a part of the printer.

5. An arrangement according to claim 1, including a plurality of grippers related to one another via endless movement-transmission means, said transmission means functioning to move intermittently so as to afford simultaneous registration of a first gripper in the laying-on station and registration of a second gripper in relation to the printing table.

6. An arrangement according to claim 1, wherein a movement path of the squeegee relative to a stand forming a part of the printer and a movement path of the frame relative to the stand are mutually equal, the sum of said movement paths being adapted to the length extension of the printed patter in the transport direction.

7. An arrangement according to claim 2, including a plurality of grippers related to one another via endless movement-transmission means, said transmission means functioning to move intermittently so as to afford simultaneous registration of a first gripper in the laying-on station and registration of a second gripper in relation to the printing table.

8. An arrangement according to claim 4, wherein a movement path of the squeegee relative to a stand forming a part of the printer and a movement path of the frame relative to the stand are mutually equal, the sum of said movement paths being adapted to the length extension of the printed pattern in the transport direction.

* * * * *